US009034458B2

(12) United States Patent
Li

(10) Patent No.: US 9,034,458 B2
(45) Date of Patent: May 19, 2015

(54) EDGE-PROTECTED PRODUCT AND FINISHING METHOD

(75) Inventor: Xinghua Li, Horseheads, NY (US)

(73) Assignee: Corning Incorporated, Corning, NY (US)

( * ) Notice: Subject to any disclaimer, the term of this patent is extended or adjusted under 35 U.S.C. 154(b) by 578 days.

(21) Appl. No.: 13/117,564

(22) Filed: May 27, 2011

(65) Prior Publication Data

US 2012/0301683 A1 Nov. 29, 2012

(51) Int. Cl.

| | |
|---|---|
| ***B32B 23/02*** | (2006.01) |
| ***B65D 85/48*** | (2006.01) |
| ***B65D 81/05*** | (2006.01) |

(52) U.S. Cl.

CPC ..... *B65D 85/48* (2013.01); *Y10T 428/24777* (2015.01); *Y10T 156/1052* (2015.01); *B65D 81/055* (2013.01)

(58) Field of Classification Search

CPC ..... Y10T 428/24777; B65D 85/48
USPC ..... 428/192
See application file for complete search history.

(56) References Cited

U.S. PATENT DOCUMENTS

| | | | | |
|---|---|---|---|---|
| 5,220,358 | A | 6/1993 | Brown et al. | 351/159 |
| 5,585,188 | A | 12/1996 | Cheron et al. | |
| 5,609,284 | A | 3/1997 | Kondratenko | 225/1 |
| 5,622,540 | A | 4/1997 | Stevens | 65/112 |
| 5,637,363 | A | 6/1997 | Leray et al. | |
| 5,776,220 | A | 7/1998 | Allaire et al. | 65/112 |
| 6,182,940 | B1 | 2/2001 | Miyamoto et al. | 248/682 |
| 6,811,069 | B2 | 11/2004 | Hauer et al. | 225/93.5 |
| 6,815,070 | B1 | 11/2004 | Bürkle et al. | 428/425.6 |
| 6,853,123 | B1 | 2/2005 | Nattermann et al. | 313/483 |
| 7,014,082 | B2 | 3/2006 | Hauer et al. | 225/93.5 |
| 2005/0115678 | A1 | 6/2005 | Vesci et al. | 156/345.49 |

(Continued)

FOREIGN PATENT DOCUMENTS

| | | | |
|---|---|---|---|
| EP | 0 528 112 | 5/1992 | |
| EP | 0528112 | 2/1993 | C02C 1/06 |

(Continued)

OTHER PUBLICATIONS

U.S. Appl. No. 61/417,998, Methods for Separating a Sheet of Brittle Material, G.S. Glaesemann et al.

(Continued)

*Primary Examiner* — Mark Ruthkosky
*Assistant Examiner* — Christopher Polley
(74) *Attorney, Agent, or Firm* — Jeffrey A. Schmidt

(57) ABSTRACT

An edge-protected product and finishing method therefor. The product comprises a first we and a second web bonded intermittently to the peripheral regions of a major surface of the sheet material to be protected. The bonded webs provide the desired level of protection to the peripheral regions and the edge surfaces of the sheet material. The intermittent bonding allows for the clean and convenient separation of the sheet material and the webs that a continuously bonded web would not be able to provide. Where laser cutting is used to separate the protected product, the edge-protected product with intermittent bonding areas allows for the separation without laser irradiation to the web material, thus no generation of toxic fume or charring due to oxidation, melting and/or disintegration of the web material caused by laser heating. The invention is particularly useful for protecting thin glass sheets, especially those in the form of a spool.

20 Claims, 3 Drawing Sheets

(56) References Cited

U.S. PATENT DOCUMENTS

| | | | | |
|---|---|---|---|---|
| 2005/0142321 | A1 | 6/2005 | Miyahara et al. | 428/64.2 |
| 2007/0039932 | A1 | 2/2007 | Haase et al. | 219/121.67 |
| 2007/0062921 | A1 | 3/2007 | Karube et al. | 219/121.72 |
| 2007/0144656 | A1 | 6/2007 | Muromachi et al. | 156/108 |
| 2007/0151962 | A1 | 7/2007 | Doll et al. | 219/121.72 |
| 2008/0037141 | A1* | 2/2008 | Tom et al. | 359/813 |
| 2008/0213545 | A1* | 9/2008 | Allam et al. | 428/192 |
| 2010/0276066 | A1 | 11/2010 | Kondo | 156/101 |
| 2011/0023548 | A1 | 2/2011 | Garner et al. | 65/106 |

FOREIGN PATENT DOCUMENTS

| | | | |
|---|---|---|---|
| EP | 1048628 | 4/1999 | C03C 17/32 |
| EP | 1150927 | 1/2000 | C03C 17/32 |
| EP | 1137607 | 4/2000 | C03C 12/32 |
| EP | 1341730 | 9/2003 | C03B 33/09 |
| EP | 1 803 601 | 12/2006 | |
| EP | 1803601 | 4/2009 | B60J 10/00 |
| GB | 1254120 | 11/1971 | B28D 1/22 |
| JP | 08-230457 | 9/1996 | |
| JP | 2861906 | 12/1998 | |
| JP | 11-171595 | 6/1999 | |
| JP | 2002-037374 | 2/2002 | |
| JP | 2002-192367 | 7/2002 | |
| JP | 2003-002676 | 1/2003 | |
| JP | 2007-319888 | 12/2007 | |
| WO | WO00/41978 | 7/2000 | C03C 17/32 |
| WO | WO00/66507 | 11/2000 | C03C 17/32 |
| WO | WO2005/000762 | 6/2005 | C03C 27/06 |
| WO | WO2005/115678 | 8/2005 | B23K 26/40 |
| WO | WO2007/079847 | 7/2007 | C03B 33/09 |
| WO | WO2008/077042 | 6/2008 | C09D 4/00 |
| WO | WO 2008/104825 | 9/2008 | |
| WO | WO2008/104825 | 9/2008 | C03C 17/00 |
| WO | WO 2008/136872 | 11/2008 | |
| WO | WO2008/136872 | 11/2008 | H01L 31/042 |

OTHER PUBLICATIONS

U.S. Appl. No. 13/030,605, Laser Cutting Method, S.M. Garner, et al.

U.S. Appl. No. 61/469,321, Methods of Fabricating a Glass Ribbon, A.A. Abramov, et al.

K. Karube, N. Karube, "Laser-induced cleavage of LCD glass as full-body cutting", Proc. SPIE, vol. 6880, 688007-1 to 688007-10 (2008).

Machine Translation JP08230457.

PCT/US2012/036080 Search Report.

* cited by examiner

EDGE-PROTECTED PRODUCT AND FINISHING METHOD

TECHNICAL FIELD

The present invention relates to edge-protected product comprising a sheet material and edge-protecting webs, and finishing method therefor. In particular, the present invention relates to edge-protected thin glass sheet product comprising a glass sheet and edge-protecting webs bonded to the peripheral regions of the major surfaces in an intermittent fashion, and finishing method therefor. The present invention is useful, e.g., in making and finishing ultra-thin glass sheet products for use in display devices.

BACKGROUND

Thin sheet materials, such as glass plates, glass-ceramic plates, ceramic plates and crystalline wafers, and the like, are used widely in many processes and devices. Each piece of sheet material typically comprises at least two major, opposing surfaces joined by edge surfaces. During the manufacture, handling, transpiration and use of these sheet materials, they are subjected to contact with other sheet materials, equipment, tools and accordingly the impact of various external forces. Frequently, the mechanically weakest parts of the sheet material are the edge surfaces and the peripheral regions of the major surfaces. Without protection of these weak areas, the sheet material are prone to failure such as chipping, cracking and even rupture when the external force exceeds a certain limit.

Such is especially the case for glass sheet materials, especially thin glass sheets having a thickness of less than 1 mm, in certain embodiments at most 500 μm, in certain embodiments at most 300 μm, which have found extensive use in making display devices, e.g., as TFT and color filter substrates in liquid crystal displays (LCDs), organic light-emitting diode (OLED) display substrates, display cover sheets, and the like. These glass materials tend to have high surface quality, especially those made by using the overflow downdraw process, a technology pioneered by Corning Incorporated, Corning, N.Y., U.S.A. However, due to the cutting and edge finishing processes these glass sheets have to undergo, mechanical defects are not completely avoidable on the edge surfaces and in the peripheral regions of the main surfaces. Edge protection via encapsulation by using a relatively soft material was found especially conducive to reduced product cracking and other failure for thin glass sheets products.

A particularly interesting ultra-thin glass sheet product is in the form of a spool, in which a long thin glass ribbon, such as one having a thickness of 100 μm or even lower, is wound onto a mandrel to form a roll. The roll of glass ribbon may be unrolled into flat shape, subjected to surface processing such as coating deposition, semiconductor device formation, and the like, and then re-wound into a roll. This roll-to-roll process can be particularly advantageous for making various opto-electronic devices such as e-ink-based displays, photovoltaics, and the like. However, in a glass sheet roll, the glass ribbon is subjected to compressive stress on one side, and tensile stress on the other. Any edge defect or edge impact can easily lead to chipping and/or breakage. Thus, edge protection is particularly important for such glass spool.

US Patent Application Publication No. 2011/0023548A1 discloses an edge-protected glass sheet product, in which the edge surface and the peripheral regions of the main surface of the glass sheet are protected by a continuous web material such as polyimide and the like bonded to the peripheral regions. It is disclosed in this reference that the edge protection web can be used for protecting the edges of a spooled glass ribbon. While the continuous web material provides adequate protection to the glass sheet, it poses technical challenges during subsequent finishing step when the glass sheet or ribbon is cut into multiple pieces, and when the web material is removed. It was found that mechanical cutting of the web material can be difficult to align with the separation line of the glass sheet. In the case of laser cutting by using a $CO_2$ laser beam, which is advantageously used for cutting thin glass sheets, exposure of the organic web material in air to the laser beam can lead to combustion, toxic fume formation, and charring of the glass surface.

Thus, there remains a genuine need of an edge-protected product that does not have the above issues.

The present invention satisfies this and other needs.

SUMMARY

Several aspects of the present invention are disclosed herein. It is to be understood that these aspects may or may not overlap with one another. Thus, part of one aspect may fall within the scope of another aspect, and vice versa.

Each aspect is illustrated by a number of embodiments, which, in turn, can include one or more specific embodiments. It is to be understood that the embodiments may or may not overlap with each other. Thus, part of one embodiment, or specific embodiments thereof, may or may not fall within the ambit of another embodiment, or specific embodiments thereof, and vice versa.

Thus, a first aspect of the present disclosure relates to an edge-protected product comprising:

(A) a sheet material having:

(A1) a first major surface comprising a first peripheral region and a second peripheral region;

(A2) a second major surface opposing the first major surface, comprising a third peripheral region and a fourth peripheral region, wherein the first and third peripheral regions are in opposing relationship, and the second and fourth peripheral regions are in opposing relationship;

(A3) a first edge surface connecting the first and the third peripheral regions;

(A4) a second edge surface connecting the third and the fourth peripheral regions;

(B) a first web protecting the first edge surface bonded to at least one of the first and third peripheral regions at a plurality of first intermittent bonding locations; and (C) a second web protecting the second edge surface bonded to at least one of the second and fourth peripheral regions at a plurality of second intermittent bonding locations.

In certain embodiments of the product according to the first aspect, the sheet material is substantially planar or curved.

In certain embodiments of the product according to the first aspect, the sheet material is curved and the product is in the form of a spool, wherein the first peripheral region is prevented from direct contact with the third peripheral region due to the presence of the first web, and the second peripheral region is prevented from direct contact with the fourth peripheral region due to the presence of the second web.

In certain embodiments of the product according to the first aspect, the sheet material is a glass, a glass-ceramic, ceramic or crystalline material.

In certain embodiments of the product according to the first aspect, the sheet material has a thickness of at most 300 μm.

In certain embodiments of the product according to the first aspect, the first and second webs extend from the first and second edge surfaces, respectively, by a distance of at least 1 mm.

In certain embodiments of the product according to the first aspect, the first and second webs, the same or different, independently comprise a tape, a coating, or a film.

In certain embodiments of the product according to the first aspect, the first and second webs, the same or different, independently comprises a plastic material, a metal foil, a fabric, or a paper material.

In certain embodiments of the product according to the first aspect, the first and second webs are bonded to the peripheral regions by an adhesive material.

In certain embodiments of the product according to the first aspect, the first and second webs are polyimide tapes.

In certain embodiments of the product according to the first aspect, wherein the first edge surface is continuously encapsulated by the first web.

In certain embodiments of the product according to the first aspect, the second edge surface is continuously encapsulated by the second web.

In certain embodiments of the product according to the first aspect, the first edge surface is intermittently encapsulated by the first web.

In certain embodiments of the product according to the first aspect, the second edge surface is intermittently encapsulated by the second web.

In certain embodiments of the product according to the first aspect, the first intermittent bonding locations and the second intermittent bonding locations are substantially symmetrical with respect to a center line of the sheet material.

In certain embodiments of the product according to the first aspect, the first intermittent bonding locations are formed on both the first and third peripheral regions, and the second intermittent bonding locations are formed on both the second and the fourth peripheral regions.

In certain embodiments of the product according to the first aspect, the first intermittent bonding locations on the first and third peripheral regions are substantially symmetrical with respect to a center plane between the first and third peripheral regions, and the second intermittent bonding locations on the second and fourth portions are substantially symmetrical with respect to a center plane between the second and fourth peripheral regions.

In certain embodiments of the product according to the first aspect, the first web comprises registration marks indicating the locations of at least part of the first intermittent bonding locations and/or the parts of the web between adjacent first intermittent bonding locations.

In certain embodiments of the product according to the first aspect, the second web comprises registration marks indicating the locations of at least part of the second intermittent bonding locations and/or the parts of the second web between adjacent second intermittent bonding locations.

In certain embodiments of the product according to the first aspect, the first and/or the second peripheral regions comprise registration marks indicating the locations of at least part of the second intermittent bonding locations and/or the parts of the second web between adjacent second intermittent bonding locations.

A second aspect of the present disclosure relates to a method for finishing an edge-protected product, comprising the following steps:

providing an edge-protected product comprising:

(A) a sheet material having:

(A1) a first major surface comprising a first peripheral region and a second peripheral region;

(A2) a second major surface opposing the first major surface, comprising a third peripheral region and a fourth peripheral region, wherein the first and third peripheral regions are in opposing relationship, and the second and fourth peripheral regions are in opposing relationship;

(A3) a first edge surface connecting the first and the third peripheral regions;

(A4) a second edge surface connecting the third and the fourth peripheral regions;

(B) a first web protecting the first edge surface bonded to at least one of the first and third peripheral regions at a plurality of first intermittent bonding locations; and (C) a second web protecting the second edge surface bonded to at least one of the second and fourth peripheral regions at a plurality of second intermittent bonding locations; and (II) separating the sheet material along a separation line on the first major surface extending from a first separation point located in the first peripheral region to a second separation point located in the second peripheral region, wherein the first and second separation points are not bonded to the first and second webs, respectively; and (III) cutting the first and second webs in the vicinity of the separation line;

whereby the edge-protected product is severed into two discrete products.

In certain embodiments of the process of the second aspect, step (II) precedes step (III).

In certain embodiments of the process of the second aspect, step (III) precedes step (II).

In certain embodiments of the process of the second aspect, steps (II) and (III) are carried out substantially simultaneously.

In certain embodiments of the process of the second aspect, in step (II), the separation line is substantially transversal to the first edge surface and/or the second edge surface.

In certain embodiments of the process of the second aspect, in step (II), the separation line is substantially linear.

In certain embodiments of the process of the second aspect, in step (II), the first major surface in the vicinity of the separation line is curved in the direction perpendicular to the separation line.

In certain embodiments of the process of the second aspect, in step (II), the sheet material is placed on a curved air bar.

In certain embodiments of the process of the second aspect, step (II) comprises:

(IIa) forming an initiation defect on the first major surface;

(IIb) extending the initiation defect along the separation line by subjecting the first major surface to irradiation of a laser beam.

In certain embodiments of the process of the second aspect, step (IIb) results in the formation of a score-line, which is at least part of the separation line; and the method further comprises:

(IIc) subjecting the sheet material to a breaking force such that the sheet material separates into two parts along the separation line.

In certain embodiments of the process of the second aspect, in step (IIb), a full-body cutting is obtained along the separation line.

In certain embodiments of the process of the second aspect, in step (IIa), the initiation defect is formed at a location in the first peripheral region that is not bonded to the first web.

In certain embodiments of the process of the second aspect, wherein in step (IIa), the initiation defect is formed either by mechanical scribing or by laser ablation.

In certain embodiments of the process of the second aspect, in step (IIb), the first and second webs are not subjected to laser irradiation.

In certain embodiments of the process of the second aspect, in step (III), the first web or the second web is cut by a laser beam in the presence of an inert atmosphere.

In certain embodiments of the process of the second aspect, the process further comprises the following step (IV) after the completion of steps (II) and (III):

(IV) removing the first peripheral region and/or the second peripheral region, thereby obtaining a finished sheet material free of the first web or the second web.

In certain embodiments of the process of the second aspect, in step (IV), laser cutting is used, and during laser cutting, the scoring laser beam does not irradiate the first web or the second web.

In certain embodiments of the process of the second aspect, the sheet material is substantially planar or curved.

In certain embodiments of the process of the second aspect, the sheet material is curved and the product is in the form of a spool, wherein the first peripheral region is prevented from direct contact with the third peripheral region due to the presence of the first web, and the second peripheral region is prevented from direct contact with the fourth peripheral region due to the presence of the second web.

In certain embodiments of the process of the second aspect, step (II) further comprises:

(IId) unrolling the spool such that a desired length of the sheet material is released from the spool to reveal the desired location of the separation line.

In certain embodiments of the process of the second aspect, the sheet material is a glass, a glass-ceramic, ceramic or crystalline material.

In certain embodiments of the process of the second aspect, the sheet material has a thickness of at most 300 μm.

In certain embodiments of the process of the second aspect, the first and second webs extend from the first and second edge surfaces, respectively, by a distance of at least 1 mm.

In certain embodiments of the process of the second aspect, the first and second webs, the same or different, independently comprise a tape, a coating, or a film.

In certain embodiments of the process of the second aspect, the first and second webs, the same or different, independently comprises a plastic material, a metal foil, a fabric, a coating, or a paper material.

In certain embodiments of the process of the second aspect, the first and second webs are bonded to the peripheral regions by an adhesive material.

In certain embodiments of the process of the second aspect, the first and second webs are polyimide tapes.

In certain embodiments of the process of the second aspect, the first edge surface is continuously encapsulated by the first web.

In certain embodiments of the process of the second aspect, the second edge surface is continuously encapsulated by the second web.

In certain embodiments of the process of the second aspect, the first edge surface is intermittently encapsulated by the first web.

In certain embodiments of the process of the second aspect, the second edge surface is intermittently encapsulated by the second web.

In certain embodiments of the process of the second aspect, the first intermittent bonding locations and the second intermittent bonding locations are substantially symmetrical with respect to a center line of the sheet material.

In certain embodiments of the process of the second aspect, the first intermittent bonding locations are formed on both the first and third peripheral regions, and the second intermittent bonding locations are formed on both the second and the fourth peripheral regions.

In certain embodiments of the process of the second aspect, the first intermittent bonding locations on the first and third peripheral regions are substantially symmetrical with respect to a center plane between the first and third peripheral regions, and the second intermittent bonding locations on the second and fourth portions are substantially symmetrical with respect to a center plane between the second and fourth peripheral regions.

In certain embodiments of the process of the second aspect, the first web comprises registration marks indicating the locations of at least part of the first intermittent bonding locations and/or the parts of the web between adjacent first intermittent bonding locations.

In certain embodiments of the process of the second aspect, the second web comprises registration marks indicating the locations of at least part of the second intermittent bonding locations and/or the parts of the second web between adjacent second intermittent bonding locations.

In certain embodiments of the process of the second aspect, the registration marks on the first and/or second webs, and/or on the first and/or second peripheral regions guide the initiation of step (II) and/or step (III).

One or more embodiments of the various aspects of the present disclosure has one or more of the following advantages. First, without having the webs bonding to the peripheral regions of the major surfaces of the sheet material in a continuous fashion, convenient separation of the sheet material and the web materials can be achieved without the need of precise alignment of the separation line of the sheet material and the cutting lines of the web material, thereby reducing the complexity of the finishing of the edge-protected product compared to the continuous bonding along the edge in the prior art. Second, even without continuous bonding the web to the peripheral regions of the major surfaces of the sheet material, sufficient protection of the peripheral regions and the edge surfaces can be achieved, thereby preventing direct, significant impact of the edge surfaces and the peripheral regions. Thus, the edge-protected product and finishing process therefor are particularly advantageous for rolled, thin glass sheet products in the form of spools.

Additional features and advantages of the invention will be set forth in the detailed description which follows, and in part will be readily apparent to those skilled in the art from the description or recognized by practicing the invention as described in the written description and claims hereof, as well as the appended drawings.

It is to be understood that the foregoing general description and the following detailed description are merely exemplary of the invention, and are intended to provide an overview or framework to understanding the nature and character of the invention as it is claimed.

The accompanying drawings are included to provide a further understanding of the invention, and are incorporated in and constitutes a part of this specification.

DETAILED DESCRIPTION

Figure 1:
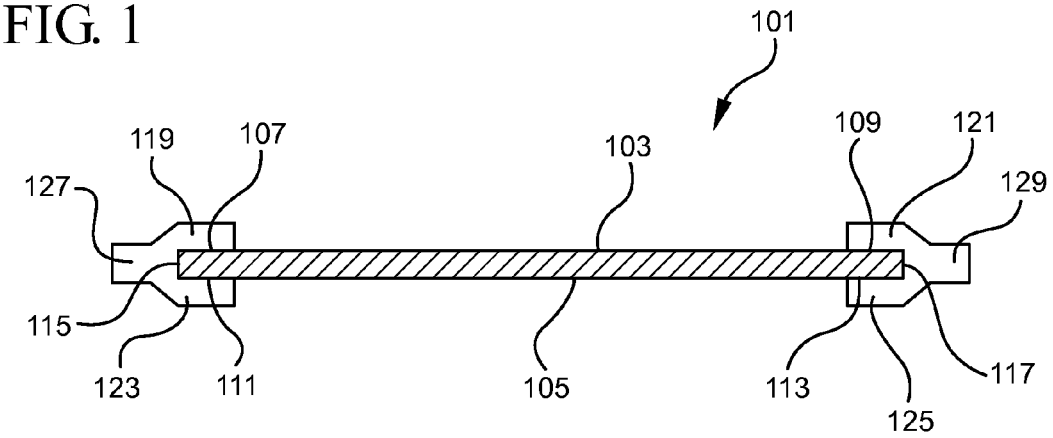
FIG. 1 is a schematic illustration of the cross-sectional view of an edge-protected sheet product according to one embodiment of the first aspect of the present invention.

In the following detailed description, for purposes of explanation and not limitation, example embodiments disclosing specific details are set forth to provide a thorough understanding of the present invention. However, it will be apparent to one having ordinary skill in the art, having had the benefit of the present disclosure, that the present invention may be practiced in other embodiments that depart from the specific details disclosed herein. Moreover, descriptions of well-known devices, methods and materials may be omitted so as not to obscure the description of the present invention. Finally, wherever applicable, like reference numerals refer to like elements.

Thus, a first aspect of the present disclosure is directed to an edge-protected product comprising:

(A) a sheet material having:

(A1) a first major surface comprising a first peripheral region and a second peripheral region;

(A2) a second major surface opposing the first major surface, comprising a third peripheral region and a fourth peripheral region, wherein the first and third peripheral regions are in opposing relationship, and the second and fourth peripheral regions are in opposing relationship;

(A3) a first edge surface connecting the first and the third peripheral regions;

(A4) a second edge surface connecting the third and the fourth peripheral regions;

(B) a first web protecting the first edge surface bonded to at least one of the first and third peripheral regions at a plurality of first intermittent bonding locations; and (C) a second web protecting the second edge surface bonded to at least one of the second and fourth peripheral regions at a plurality of second intermittent bonding locations.

FIG. 1 schematically illustrates the cross-sectional view of an edge-protected product 101 according to one embodiment of the first aspect of the present disclosure. The product comprise:

a sheet material having:

a first major surface 103 comprising a first peripheral region 107 on one side and a second peripheral region 109 on the other;

a second major surface 105 comprising a third peripheral region 111 on one side and a fourth peripheral region 113 on the other;

a first edge surface 115 connecting the first peripheral region 107 with the third peripheral region 111; and a second edge surface 117 connecting the second peripheral region 109 with the fourth peripheral region 113;

a first web 127 comprising an upper tongue structure 119 bonding with the first peripheral region 107, a lower tongue structure 123 bonding with the third peripheral region 111, and a wing structure extending beyond the first edge surface; and a second web 129 comprising an upper tongue structure 121 bonding with the second peripheral region 109, a lower tongue structure 125 bonding with the fourth peripheral region 113, and a wing structure extending beyond the second edge surface.

In this embodiment, the first and second webs encapsulate, at least in the vicinity of the bonding locations, the peripheral regions and the first and second edge surfaces.

Thus, the edge-protected product according to the first aspect of the present disclosure comprises a sheet material to be protected, and two webs protecting two edge surfaces and the adjacent peripheral regions of the first and second major surfaces. The sheet material can be substantially planar or curved. Where the sheet material is curved, it can take various shapes, such as the external surface of a cone, or a part thereof, the external surface of a cylinder, or a part thereof, a loose roll where the two major surfaces are separated by a substantial distance, or a compact roll where the two major surfaces are separated by a small distance. In a particularly advantageous embodiment, the edge-protected product takes the form of a spool, which is essentially a compact roll product, where a glass ribbon is wound on a center mandrel to form multiple layers. Inside the spool, the first peripheral region is prevented from direct contact with the third peripheral region due to the presence of the first web, and the second peripheral region is prevented from direct contact with the fourth peripheral region due to the presence of the second web. Between the first and second major surfaces inside the spool, there may be an additional interleaf material, made of paper, plastic, fabric, metal foil, or other material, that further separates the two major surfaces to prevent them from direct contact with each other. Due to the presence of the first and second webs, direct contact between the first and second major surfaces may be prevented without an interleaf material at all, especially in embodiments where the overall width of the sheet material from the first edge surface to the second edge surface is relatively small.

Figure 2:
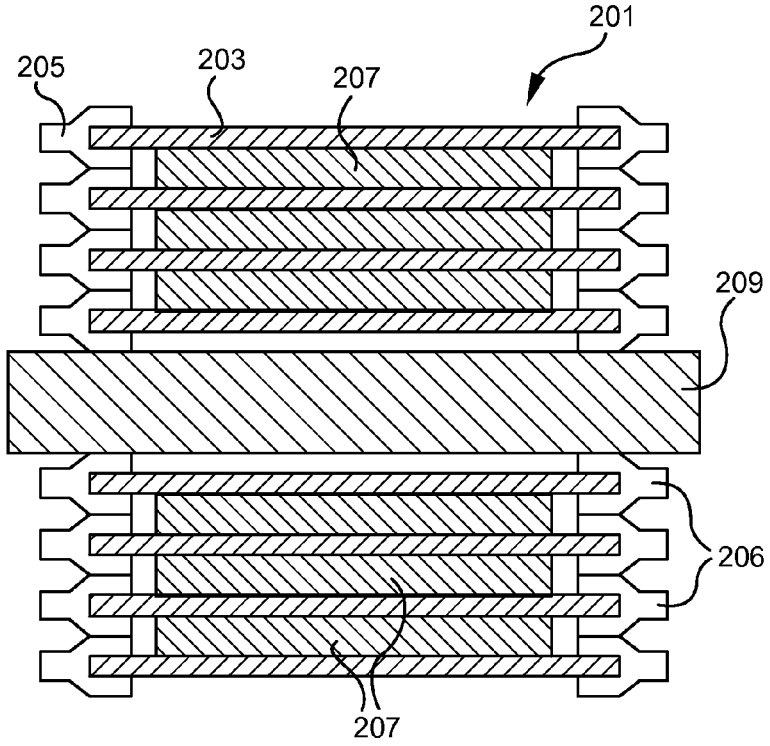
FIG. 2 is a schematic illustration of the cross-sectional view of an edge-protected sheet product in the form of a spool according to another embodiment of the first aspect of the present disclosure.

FIG. 2 schematically illustrates the cross-sectional view of an edge-protected product in the form of a spool according to certain embodiments of the first aspect of the present disclosure. In this figure, around a mandrel 209, a long ribbon of a sheet material 203 is wound into a roll. The peripheral regions of both major surfaces of the sheet material are bonded intermittently to the first web 205 and the second web 206, respectively. Between the first and second major surfaces, an interleaf material 207 is inserted. The edge-protecting webs 205 and 206, protect the edge surfaces and the peripheral regions from direct contact with handling tool and equipment, thereby reducing probability of chipping, cracking and rupture. The rolled product may be unrolled, stretched and flattened to allow surface of the sheet material to be processed to form surface coatings, semiconductive material deposition and device fabrication, and then taken up into another roll.

The sheet material protected in the edge-protected product according to the first aspect of the present disclosure can be a glass, a glass-ceramic, a ceramic or a crystalline material, or other materials. In a particularly advantageous embodiment, the sheet material consists essentially of a glass. The sheet material may comprise a single layer of substantially homogeneous material, or multiple layers of different materials. For example, in one embodiment, the sheet material consists of a single layer of glass. In another embodiment, the sheet material comprise a core layer of glass and two cladding layers of glass with differing compositions and differing CTE from the core layer. In yet another embodiment, the sheet material comprise a glass substrate coated with a thin layer of a different material, such as a metal, an amorphous semiconductor, or a polycrystalline semiconductor. In yet another embodiment, the sheet material is a thin wafer of single crystalline material, such as silicon.

While the edge-protected product of the first aspect of the present disclosure can comprise a sheet material with any thickness, it is advantageously a thin sheet material having a thickness of at most 300 μm. As mentioned supra, edge protection of thin glass sheets, especially those in the form of a roll, is particularly useful.

In order to confer adequate protection of the edge surfaces and the peripheral regions of the first and second major surfaces, the first and second webs advantageously extend from the edge surface by an adequate distance such as at least 1 mm. The first and second webs may cover peripheral regions as wide as 50 mm or even wider.

The first and second webs may be made of the same or different materials, and may have substantially the same or different geometry and dimensions. In certain embodiments, the first and second webs may independently comprise a tape, a coating, a film, a fabric, and the like. It is desired that the web material is soft and flexible, so that impact thereon can be absorbed or alleviated without being transferred to the protected edge surfaces and peripheral regions at a proportion detrimental thereto. The first and second web material may be an organic plastic, a metal foil such as an aluminum foil, a fabric such as polyethylene terephthalate (PET), and the like. The first and second webs are bonded to the peripheral regions by, e.g., an adhesive. A particularly advantageous example of the first and second webs is polyimide tape comprising a layer of acrylic adhesive bonding with the peripheral regions. In certain advantageous embodiments, the first and second webs are also bonded to the first and second edge surfaces, respectively, intermittently. In another embodiment, the first and second webs are not bonded to the first and second edge surfaces.

The first and second webs are bonded to the relevant peripheral regions only in an intermittent manner according to the first aspect of the present disclosure. In contrast, as indicated supra, the protecting webs as disclosed in United States Patent Application Publication No. 2011/0023548A1 bonds with the peripheral regions substantially continuously, which poses challenges to cutting thereof during a finishing step. The edge-protected product according to the first aspect of the present disclosure, by providing intermittent bonding between the first and second webs and the peripheral regions, enables easy cutting of the webs and thereby solves this problem.

Figure 3:
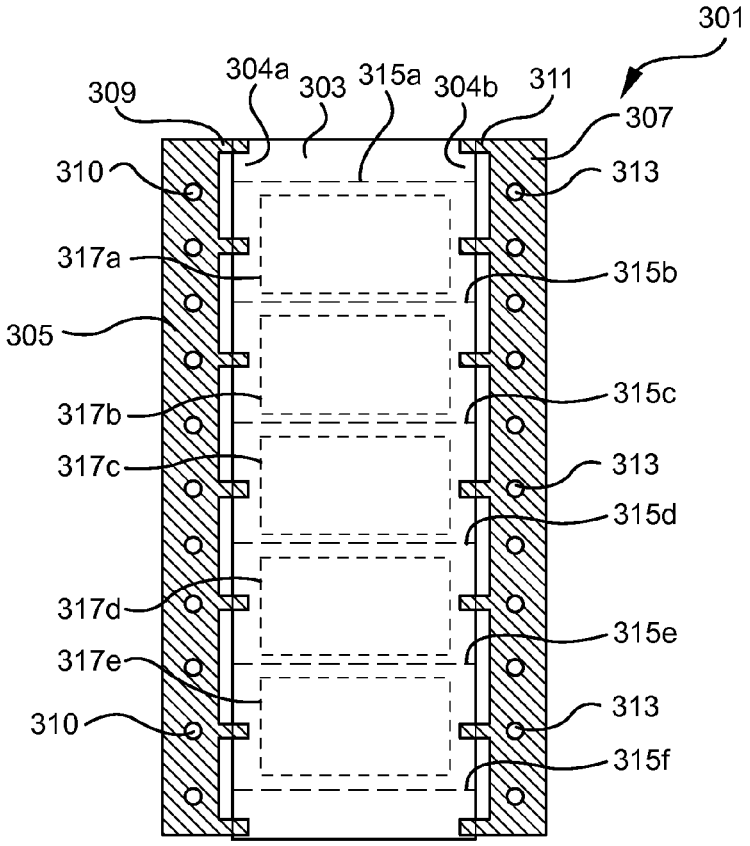
FIGS. 3 to 5 are schematic illustrations of the top-view of edge-protected sheet products according to various embodiments of the first aspect of the present disclosure.
Figure 4:
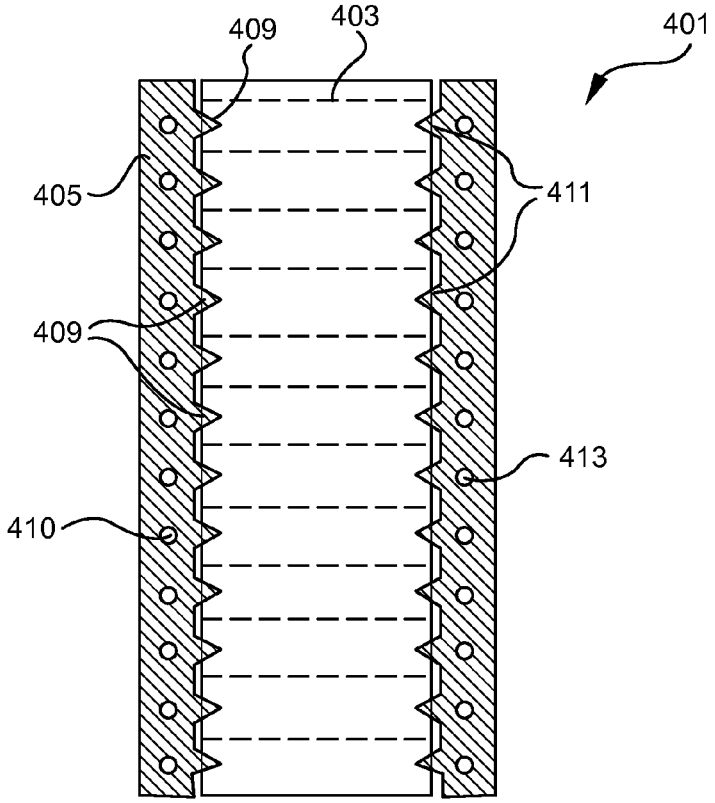

FIGS. 3 and 4 schematically illustrate the front views of certain embodiments of the edge-protected products 301 and 401 according to the first aspect of the present disclosure. In FIG. 3, the edge-protected product 301 comprises a sheet material having a first major surface 303 comprising a first peripheral region 304*a* and as second peripheral region 304*b*, a first edge surface 306*a* and a second edge surface 306*b*, a first web 305 comprising a series of protruding tongue structures 309 bonded to the first peripheral region 304*a* at a plurality of first bonding locations, and a second web 307 comprising a series of protruding tongue structures 311 bonded to the second peripheral region 304*b* at a plurality of second bonding locations. Because the adjacent tongue structures 309 on the first web 305 and 311 on the second web 307 are separated from each other by a distance, the first bonding locations between the first web and the first peripheral region are intermittent and discontinuous, and so are the second bonding locations between the second web and the second peripheral region. In a finishing step in which the edge-protected product is cut into multiple pieces, scoring and breaking or laser separation operations may be carried out along the separation lines 315*a*, 315*b*, 315*c*, 315*d*, 315*e*, 315*f*, and the like to effect the separation of the sheet material 303, and the first and second web materials in the vicinity of the separation lines, not bonded to the peripheral regions of the major surfaces of the sheet material, can be cut by shearing using a pair of scissors, a knife, or laser beam irradiation. Once both the sheet material is separated along a separation line, and the first and second webs severed between adjacent bonding locations close to the separation line, the edge-protected product is separated into two discrete edge-protected pieces. At a later step, score-and-break or laser scoring, or other cutting methods, may be used to extract sheet material pieces without edge protection along the dotted perimeters, shown in FIG. 3 as 317*a*, 317*b*, 317*c*, 317*d* and 317*e*, from the individual edge-protected pieces. The protruding tongue structures bonding to the first and second peripheral regions are substantially rectangular in FIG. 3. However, other tongue shapes, such as serrated tooth shape, shown in FIG. 4 as 409 and 411, semicircular, elliptical, and the like, are also possible.

The first intermittent bonding locations may be on only one of the first and second major surfaces of the sheet material, or they may be present on both major surfaces. In the latter case, it is desired that the first web provides intermittent capsulation of the first edge surface. Such intermittent capsulation can be effected by using a first web having two tongues corresponding to the same location of the first edge surface, each bonded to the first and third peripheral regions, respectively.

Likewise, the second intermittent bonding locations may be on only one of the first and second major surfaces of the sheet material, or they may be present on both major surfaces. In the latter case, it is desired that the second web provides intermittent capsulation of the second edge surface. Such intermittent capsulation can be effected by using a second web having two tongues corresponding to the same location of the second edge surface, each bonded to the second and fourth peripheral regions, respectively.

Figure 5:
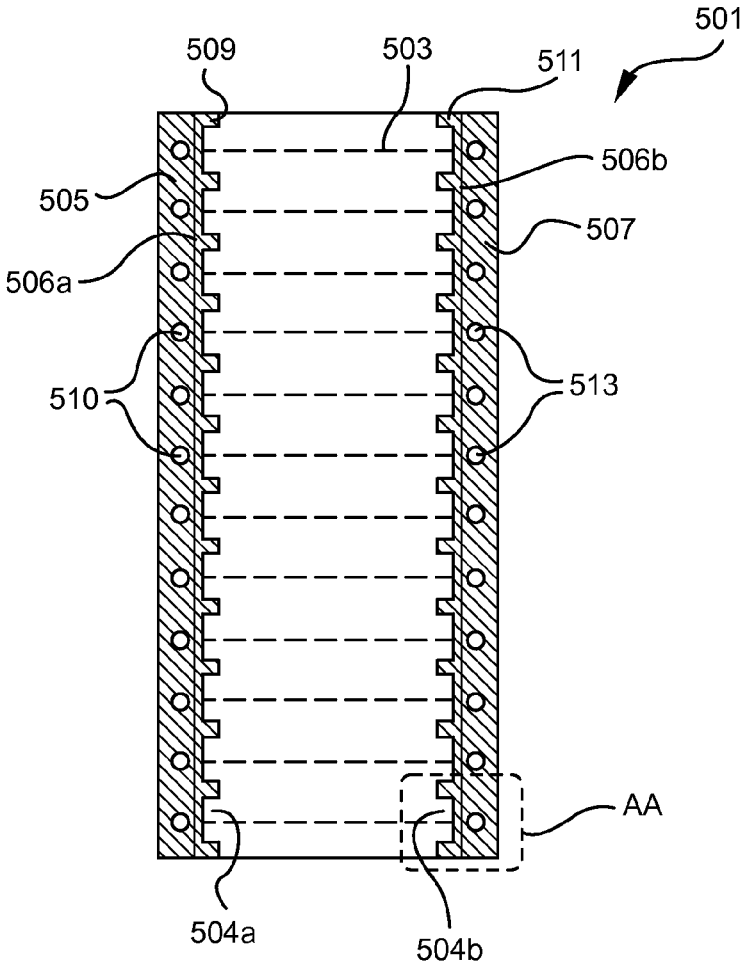
Figure 6:
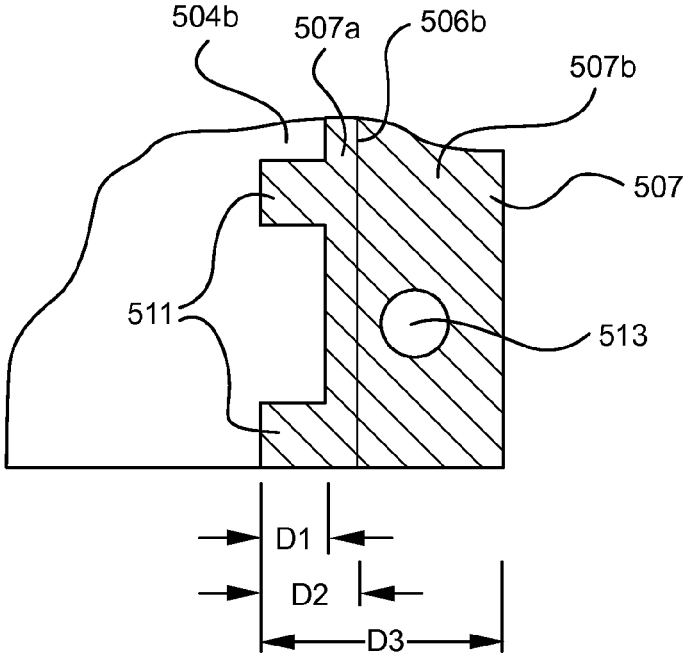
FIG. 6 is a schematic illustration of the enlarged area AA illustrated in FIG. 5.

In certain embodiments, a band of the first peripheral region next to the first edge surface and/or the second edge surface is continuously encapsulated by the first and/or second webs, respectively. FIG. 5 schematically show an example of this embodiment, where the first web 505 and the second web 507 comprise a plurality of tongue structures 509 and 511 bonding with the first and second peripheral regions of the first major surface 503 of the sheet material, similar to the embodiment of FIG. 3, described supra. In addition, the first webs 505 and second web 507 further comprise a part substantially continuously covering part of the first and second peripheral regions. FIG. 6 shows an enlarged view of the dotted line area AA in FIG. 5. Thus, as shown in FIG. 6, the second web comprises tongs 511 directly forming the second intermittent bonding locations with the second peripheral region 504*b*, a substantially continuous portion 507*a* covering a continuous narrow band of the second peripheral region next to the second edge surface, and an outer portion 507*b* extending beyond the second edge surface. In certain embodiments, a band of the first and third peripheral regions next to the first edge surface, and a band of the second and fourth peripheral regions next to the second edge surface are continuously encapsulated by the first and second webs, resulting in complete encapsulation of both the first and second edge surfaces. It should be noted that the continuous first and/or second web parts covering the peripheral bands next to the edge surfaces are not bonded to the peripheral regions of the major surface between the adjacent tongues. Nonetheless, this full edge surface encapsulation design provides especially robust protection of the edge surfaces and the adjacent peripheral regions of the major surfaces to substantially the same degree of the full-bonded web design disclosed in United States Patent Application Publication No. 2011/0023548A1 by preventing the edge surfaces from coming into direct contact with each other or tools and equipment, without the drawbacks thereof mentioned supra.

In certain embodiments, it is desired that the first intermittent bonding locations and the second intermittent bonding locations are substantially symmetrical with respect to a center line of the sheet material. This symmetrical distribution of the first and second intermittent bonding locations can facilitate the severance of the sheet material and the first and second webs along a separation line substantially transversal to the first and/or second edge surfaces, such as those shown in FIG. 3, which can be particularly advantageous for extracting rectangular sheet materials from the product in a finishing step.

In certain embodiments, it is desired that the first intermittent bonding locations are present on both the first and third peripheral regions, and that they are distributed substantially symmetrically with respect to a center plane between the first and third peripheral regions. This embodiment provides the intermittent encapsulation of the first edge surface described supra. Likewise, in certain embodiments, it is desired that the second intermittent bonding locations are present on both the second and fourth peripheral regions, and that they are distributed substantially symmetrically with respect to a center plane between the second and forth peripheral regions. This embodiment provides the intermittent encapsulation of the second edge surface described supra. In certain embodiments, it is desirable that intermittent encapsulation of both the first and second edge surfaces are provided by the first and second intermittent bonding locations.

In certain embodiments, it is advantageous to provide registration marks and/or fiduciary marks on the first and/or second web, and/or on the first, second, third and/or fourth peripheral regions of the sheet material. Such registration marks can be mechanical perforation, indentation or printed marks of various geometry and/or dimension. For example, FIGS. 3, 4 and 5 show registration marks 313, 413 and 513 on both the first and second webs in the form of perforations. These perforations may serve additional functions such as engagement with conveyer rollers having surface protrusions to provide the driving force needed for moving the product on a production line.

The bonding and affixation of the first web and the second web to the intended peripheral regions can be achieved by various means. For example, in one embodiment, a fluidic precursor coating material can be applied to the intended peripheral regions on one or both sides of the major surface extending beyond the edge surface, and allowed to cure into a soft, solid web by heating or exposure to UV irradiation. In another example, a pre-formed tape having pressure-sensitive adhesives pre-applied on one side thereof can be diced into the geometry of the first and second webs shown in FIGS. 3 and 4, and then applied to the first and second peripheral regions by pressing the protruding tongue structures onto the respective first and second intermittent bonding locations, where the pressure-sensitive adhesive provides the desired level of bonding with the peripheral regions. In yet another example, a single piece of tape comprising press-sensitive adhesive on one side thereof is diced on both edges to form the protruding tongue structures, folded along its centerline to obtain a Y-shape structure, and then affixed to the opposing peripheral regions of the two opposing major surfaces as shown in FIG. 1.

A second aspect of the present disclosure is a method for finishing an edge-protected product according to the first aspect of the present disclosure, comprising the following steps:

(I) providing an edge-protected product according to the first aspect of the present disclosure, described supra;

(II) separating the sheet material along a separation line on the first major surface extending from a first separation point located in the first peripheral region to a second separation point located in the second peripheral region, wherein the first and second separation points are not bonded to the first and second webs, respectively; and (III) cutting the first and second webs in the vicinity of the separation line;

whereby the edge-protected product is severed into two discrete products.

The process according to the second aspect of the present disclosure may be carried out after the edge-protected product has been subjected to various previous treatments, such as surface coating deposition, surface device construction, washing, drying, and the like. In the process, step (II) may precede step (III) in certain embodiments, step (III) may precede step (II) in certain other embodiments, and steps (II) and (III) may be carried out substantially simultaneously or in an overlapping fashion in certain other embodiments. The separation line is advantageously transversal relative to the first and/or second edge surfaces. The separation line may be substantially linear, or curved, to suit the different needs of the subsequent steps or use of the cut product.

In certain embodiments of the process according to the second aspect of the present disclosure, in step (II), the first major surface of the sheet material may be curved in the direction perpendicular to the separation line in the vicinity thereof. The curvature of the sheet material can provide the stiffness in the direction of the separation line desired for successful cutting and separation of the sheet material along the separation line. To achieve this desired curvature in the direction perpendicular to the separation line, one may place the sheet material on a curved air bar on which the sheet material can be suspended while the sheet material is being cut and separated.

Step (II) of the process according to the second aspect of the present disclosure may comprise a mechanical scribe-and-break step, in which a mechanical scribing wheel first scribes the first major surface along the separation line to form a score-line, and the sheet material is then broken along the score-line by subjecting it to a separation force enabling the complete separation of the sheet material along the separation line. Alternatively, laser cutting may be used. As used herein, "laser cutting" broadly includes a score-and-break process where a laser beam is used to create the score-line such as a process described in U.S. Provisional Patent Application No. 61/417,998 filed on Nov. 30, 2010 and entitled "METHODS FOR SEPARATING A SHEET OF BRITTLE MATERIAL," the relevant content of which is incorporated herein by reference in its entirety, and a full-body cutting process by laser irradiation only without the need of bending, such as a process described in U.S. patent application Ser. No. 13/030,605 filed on Feb. 18, 2011 and entitled "LASER CUTTING METHOD," or a process described in U.S. Provisional Patent Application No. 61/469,321 filed on Mar. 30, 2011 and entitled "METHODS OF FABRICATING A GLASS RIB- BON," the relevant content thereof is incorporated herein by reference in its entirety. A laser process can advantageously comprise:

(IIa) forming an initiation defect on the first major surface;

(IIb) extending the initiation defect along the separation line by subjecting the first major surface to irradiation of a laser beam.

In a laser scoring process, an initiation defect is typically first formed by mechanical scribing using a scribing wheel, a scratching tool with a diamond tip, or laser ablation, and the like, in the vicinity of the separation line. Subsequently, a laser beam is irradiated to the score-line in the vicinity of the initiation defect. Subsequent cooling of the exposed area, by an air jet, a water jet, or natural cooling by ambient air, results in a tensile stress along the score-line, which causes the initiation defect to extend along the score-line to form a vent, which may extend through the full width of the separation line, or part of it. Subsequently, a step (IIc) is carried out:

(IIc) subjecting the sheet material to a breaking force such that the sheet separates into two parts along the separation line.

The breaking force can be a force that imparts a bending moment to the sheet material along the separation line, which causes the vent in the score-line to extend throughout the thickness of the sheet material, effecting the separation of the sheet material.

For very thin sheet material, full laser cutting may be effectively and advantageously used to achieve the separation of the sheet material along the separation line. The full body laser cutting process also typically starts with the formation of an initiation defect on the first major surface in the vicinity of the separation line as well. It should be noted that the extending direction of the initiation defect can be in the same as, or different from, the direction of the separation line. The exposure of the sheet material surface along the separation line to a laser beam, by scanning in certain embodiments, followed by active or passive cooling using water jet, air jet or natural ambient air cooling, and the like, results in the initiation defect to extend throughout the depth and the width of the sheet material, leading to a full-body cutting of the sheet along the separation line.

In certain advantageous embodiments using laser, in step (IIa), the initiation defect is formed at a location in the peripheral region that is not bonded to the first web. Such choice of initiation defect location can ensure the separation line extends from a location in proximity to the first edge that is not bonded to the first web to a location in proximity to the second edge surface that is not bonded to the second web. As discussed supra, a main advantage of the present disclosure lies in the fact that the separation of the edge-protected product is possible and relatively convenient without having the technical difficulty of severing the web material continuously bonded to the peripheral regions of the sheet material surfaces.

In certain embodiments, it is desired that during step (IIb), the first and second webs are not subjected to laser irradiation. This avoids the formation of fume and charring to the sheet material surface when the web material melts, disintegrates, oxidizes and/or burns due to the high temperature caused by laser irradiation. To sever the first and/or second web material in step (III), one can use a shearing device such as a pair of scissors, or a slicing tool, such as a knife, a doctor blade, and the like, before, during or after step (II). Once both steps (II) and (III) are carried out, a single product is severed into two discrete products having edges protected by the first and second webs.

In another advantageous embodiment, in step (III), the first and/or the second webs are cut by a laser beam in the presence of an inert atmosphere such as $CO_2$, $N_2$, $H_2O$, Ar, and mixtures of at least two thereof. In an inert atmosphere, when the first and/or second webs are exposed to laser irradiation, they will be heated to a high temperature where they melt and disintegrate without oxidation and burning, leading to a relatively cleaner cut than would be achievable by laser exposure in the present of air.

Upon severing an edge-protected product into two or more discrete products each having edges protected by the webs, it may still be desirable to remove those webs in order to extract a clean sheet material piece. This can be achieved by the following step (IV):

(IV) removing the first peripheral region and/or the second peripheral region, thereby obtaining a finished sheet material free of the first web or the second web.

Step (IV) can be carried out using a technique the same as or different from that used in step (II), described in detailed supra. If laser irradiation is used in step (IV), it is desired that the laser irradiation is not delivered directly to the first and/or second web materials.

The method according to the second aspect of the present disclosure can be used for finishing an edge-protected product comprising a sheet material that is substantially planar or curved, described supra in connection with the first aspect of the present disclosure. In the case of a curved product, it can take various shapes, such as the external surface of a cone, or a part thereof, the external surface of a cylinder, or a part thereof, a loose roll where the two major surfaces are separated by a substantial distance, or a compact roll where the two major surfaces are separated by a small distance. In a particularly advantageous embodiment, the edge-protected product takes the form of a spool, which is essentially a compact roll product, where a glass ribbon is wound on a center mandrel to form multiple layers. Inside the spool, the first peripheral region is prevented from direct contact with the third peripheral region due to the presence of the first web, and the second peripheral region is prevented from direct contact with the fourth peripheral region due to the presence of the second web. Between the first and second major surfaces inside the spool, there may be an additional interleaf material, made of paper, plastic, fabric, metal foil, or other material, that further separates the two major surfaces to prevent them from direct contact with each other. Due to the presence of the first and second webs, direct contact between the first and second major surfaces may be prevented without an interleaf material at all, especially in embodiments where the overall width of the sheet material from the first edge surface to the second edge surface is relatively small. When finishing a spooled product using a process according to the second aspect of the present disclosure, part of the product is typically first unrolled from the spool, stretched to desired length and a position where a linear separation line can be formed extending throughout the full width thereof at a predetermined location, and then steps (II) and/or (III) are then carried out. This finishing process may be carried out continuously to obtain multiple discrete, smaller pieces of sheet materials. Of course, before steps (II) and (III) are carried out, in a spooled product comprising interleaf material as shown in FIG. 2, it is highly desired that the interleaf material is partially removed from the spool to reveal the area where the desired separation line is located, so that scoring and/or cutting can be conducted directly on the surface of the first major surface.

The registration marks formed on the first and/or second webs, and/or on the peripheral regions of the first and/or second major surfaces, of the edge-protected glass products can be advantageously used in guiding the processing of the product such as surface coating formation, crystalline material deposition, surface device fabrication, and the like, by enabling precise positioning of the sheet material, even in a continuous process. The registration marks, by providing information of the first and/or intermittent bonding locations, and/or the locations of the areas of the peripheral regions not bonded to the web material, can be advantageously used in the finishing process according to the second aspect of the present disclosure as well. To that end, the registration marks can be used to control the timing and location of the formation of the initiation defects, the onset of the scoring and/or cutting step, and the speed of a scoring wheel or the scanning speed of a laser.

It will be apparent to those skilled in the art that various modifications and alterations can be made to the present invention without departing from the scope and spirit of the invention. Thus, it is intended that the present invention cover the modifications and variations of this invention provided they come within the scope of the appended claims and their equivalents.

What is claimed is:

1. An edge-protected product comprising:

(A) a sheet material having:

(A1) a first major surface comprising a first peripheral region and a second peripheral region;

(A2) a second major surface opposing the first major surface, comprising a third peripheral region and a fourth peripheral region, wherein the first and third peripheral regions are in opposing relationship, and the second and fourth peripheral regions are in opposing relationship;

(A3) a first edge surface connecting the first and the third peripheral regions;

(A4) a second edge surface connecting the second and the fourth peripheral regions;

(B) a first web comprising a continuous portion extending along a longitudinal axis and tongue structures extending from the continuous portion, the tongue structures being spaced from one another in the direction of the longitudinal axis, the tongue structures of the first web being bonded to at least one of the first and third peripheral regions at a plurality of first intermittent bonding locations, so that the continuous portion of the first web is spaced from the first edge surface whereby a portion of the first edge is uncovered; and (C) a second web comprising a continuous portion extending along a longitudinal axis and tongue structures extending from the continuous portion, the tongue structures of the second web being spaced from one another in the direction of the longitudinal axis and being bonded to at least one of the second and fourth peripheral regions at a plurality of second intermittent bonding locations, so that the continuous portion of the second web is spaced from the second edge surface whereby a portion of the second edge is uncovered.

2. An edge-protected product comprising:

(A) a sheet material having:

(A1) a first major surface comprising a first peripheral region and a second peripheral region;

(A2) a second major surface opposing the first major surface, comprising a third peripheral region and a fourth peripheral region, wherein the first and third peripheral regions are in opposing relationship, and the second and fourth peripheral regions are in opposing relationship;

(A3) a first edge surface connecting the first and the third peripheral regions;

(A4) a second edge surface connecting the second and the fourth peripheral regions;

(B) a first web bonded to at least one of the first and third peripheral regions at a plurality of first intermittent bonding locations; and (C) a second web bonded to at least one of the second and fourth peripheral regions at a plurality of second intermittent bonding locations; and (D) a mandrel around which the sheet is wound to form a roll wherein the sheet material is curved around the mandrel, wherein the first peripheral region is prevented from direct contact with the third peripheral region due to the presence of the first web, and the second peripheral region is prevented from direct contact with the fourth peripheral region due to the presence of the second web.

3. The product according to claim 1, wherein the sheet material has a thickness of at most 300 μm.

4. The product according to claim 1, wherein the first and second webs are polyimide tapes.

5. The product according to claim 2, wherein the first edge surface and/or the second edge surface are continuously encapsulated by the first web.

6. The product according to claim 1, wherein the first edge surface and the second edge surface are intermittently encapsulated by the first web.

7. The product according to claim 1, wherein the first intermittent bonding locations and the second intermittent bonding locations are substantially symmetrical with respect to a center line of the sheet material.

8. The product according to claim 1, wherein the first intermittent bonding locations are formed on both the first and third peripheral regions, and the second intermittent bonding locations are formed on both the second and the fourth peripheral regions.

9. The product according to claim 8, wherein the first intermittent bonding locations on the first and third peripheral regions are substantially symmetrical with respect to a center plane between the first and third peripheral regions, and the second intermittent bonding locations on the second and fourth portions are substantially symmetrical with respect to a center plane between the second and fourth peripheral regions.

10. The product according to claim 1, wherein the first web and/or the second web and/or the first peripheral region and/or the second peripheral region comprise registration marks indicating the locations of at least part of the first intermittent bonding locations and/or the parts of the web between adjacent first intermittent bonding locations.

11. A method for finishing an edge-protected product, comprising the following steps:

(I) providing an edge-protected product comprising:

(A) a sheet material having:

(A1) a first major surface comprising a first peripheral region and a second peripheral region;

(A2) a second major surface opposing the first major surface, comprising a third peripheral region and a fourth peripheral region, wherein the first and third peripheral regions are in opposing relationship, and the second and fourth peripheral regions are in opposing relationship;

(A3) a first edge surface connecting the first and the third peripheral regions;

(A4) a second edge surface connecting the second and the fourth peripheral regions;

(B) a first web comprising a continuous portion extending along a longitudinal axis and tongue structures extending from the continuous portion, the tongue structures being spaced from one another in the direction of the longitudinal axis, the tongue structures of the first web being bonded to at least one of the first and third peripheral regions at a plurality of first intermittent bonding locations, so that the continuous portion of the first web is spaced from the first edge surface whereby a portion of the first edge is uncovered; and (C) a second web comprising a continuous portion extending along a longitudinal axis and tongue structures extending from the continuous portion, the tongue structures of the second web being spaced from one another in the direction of the longitudinal axis and being bonded to at least one of the second and fourth peripheral regions at a plurality of second intermittent bonding locations, so that the continuous portion of the second web is spaced from the second edge surface whereby a portion of the second edge is uncovered;

(II) separating the sheet material along a separation line on the first major surface extending from a first separation point located in the first peripheral region to a second separation point located in the second peripheral region, wherein the first and second separation points are not bonded to the first and second webs, respectively; and (III) cutting the first and second webs in the vicinity of the separation line;

whereby the edge-protected product is severed into two discrete products.

12. The method according to claim 11, wherein:

step (II) precedes step (II); or step (III) precedes step (II); or step (II) and (II) are carried out substantially simultaneously.

13. The method according to claim 11, wherein in step (II), the first major surface in the vicinity of the separation line is curved in the direction perpendicular to the separation line.

14. The method according to claim 11, wherein step (II) comprises:

(IIa) forming an initiation defect on the first major surface;

(IIb) extending the initiation defect along the separation line by subjecting the first major surface to irradiation of a laser beam.

15. The method according to claim 14, wherein step (IIb) results in the formation of a score-line, which is at least part of the separation line; and the method further comprises:

(IIc) subjecting the sheet material to a breaking force such that the sheet separates into two parts along the separation line.

16. The method according to claim 14, wherein in step (IIa), the initiation defect is formed at a location in the first peripheral region that is not bonded to the first web.

17. The method according to claim 14, wherein in step (IIb), the first and second webs are not subjected to laser irradiation.

18. The method according to claim 14, further comprising the following step (IV):

(IV) removing the first peripheral region and/or the second peripheral region, thereby obtaining a finished sheet material free of the first web or the second web.

19. The method according to claim 11, wherein the sheet material is curved and the product is in the form of a spool, wherein the first peripheral region is prevented from direct contact with the third peripheral region due to the presence of the first web, and the second peripheral region is prevented from direct contact with the fourth peripheral region due to the presence of the second web, and step (II) further comprises:

(IId) unrolling the spool such that a desired length of the sheet material is released from the spool to reveal the desired location of the separation line.

20. The method according to claim 11, wherein the first web and/or the second web and/or the first peripheral region and/or the second peripheral region comprise registration marks indicating the locations of at least part of the first intermittent bonding locations and/or the parts of the web between adjacent first intermittent bonding locations, and the registration marks guide the separating along the separation line in step (II).

* * * * *